US009024789B2

(12) United States Patent
Zhu

(10) Patent No.: US 9,024,789 B2
(45) Date of Patent: May 5, 2015

(54) METHOD FOR DETERMINING THE SEQUENCE OF VEHICLE TAGGED WITH AND WITHOUT RFID

(75) Inventor: Jeffrey C Zhu, Shanghai (CN)

(73) Assignee: Digican (Shanghai) Corp., Ltd., Shanghai (CN)

( * ) Notice: Subject to any disclaimer, the term of this patent is extended or adjusted under 35 U.S.C. 154(b) by 153 days.

(21) Appl. No.: 13/996,003

(22) PCT Filed: Dec. 14, 2011

(86) PCT No.: PCT/CN2011/083942
§ 371 (c)(1),
(2), (4) Date: Jul. 30, 2013

(87) PCT Pub. No.: WO2012/083808
PCT Pub. Date: Jun. 28, 2012

(65) Prior Publication Data

US 2013/0300585 A1 Nov. 14, 2013

(30) Foreign Application Priority Data

Dec. 21, 2010 (CN) ..... 2010 1 0598682

(51) Int. Cl.
*G08G 1/01* (2006.01)
*G08G 1/042* (2006.01)
*G08G 1/017* (2006.01)

(52) U.S. Cl.
CPC ..... *G08G 1/042* (2013.01); *G08G 1/017* (2013.01)

(58) Field of Classification Search
None
See application file for complete search history.

(56) References Cited

U.S. PATENT DOCUMENTS

| | | | | |
|---|---|---|---|---|
| 4,888,591 | A * | 12/1989 | Landt et al. | 342/44 |
| 5,101,200 | A * | 3/1992 | Swett | 340/937 |
| 5,485,520 | A * | 1/1996 | Chaum et al. | 705/74 |
| 5,554,984 | A * | 9/1996 | Shigenaga et al. | 340/937 |
| 6,535,143 | B1 | 3/2003 | Miyamoto et al. | |
| 2006/0145893 | A1 * | 7/2006 | Hassett | 340/928 |
| 2009/0174575 | A1 * | 7/2009 | Allen et al. | 340/933 |
| 2010/0271188 | A1 * | 10/2010 | Nysen | 340/10.41 |
| 2011/0165844 | A1 * | 7/2011 | Jain et al. | 455/63.1 |
| 2011/0307305 | A1 * | 12/2011 | Kohli et al. | 705/13 |
| 2014/0333472 | A1 * | 11/2014 | Nagy | 342/133 |

FOREIGN PATENT DOCUMENTS

| | | | |
|---|---|---|---|
| CN | 1263623 | A | 8/2000 |
| CN | 1369866 | A | 9/2002 |
| CN | 101866499 | A | 10/2010 |
| CN | 102316413 | A | 1/2012 |
| JP | 2001307287 | A | 11/2001 |
| JP | 2008185523 | A | 8/2008 |

* cited by examiner

*Primary Examiner* — Curtis King
(74) *Attorney, Agent, or Firm* — Mark M. Friedman

(57) ABSTRACT

A method for determining the sequence of vehicle tagged with and without an RFID, comprises: f1. carrying out multiple receiving and transmitting communications with an RFID tag in a read-write region by using an RFID reader-writer, recording success and failure operations; f2. setting a time window, moving the time window from left to right on a time axis, adding the success times of the receiving and transmitting communications to obtain a curve a; f3. detecting vehicles in the read-write region by using a ground induction coil to obtain a curve b; f4: when detecting a square wave in the curve b, indicating there is at least one vehicle driving through the coil, judging whether the driven through vehicle is installed with an RFID tag according to the wave time relationship between the curves a and b, judging whether there is a vehicle without an RFID tag among the vehicles with RFID tags driving through.

6 Claims, 8 Drawing Sheets

METHOD FOR DETERMINING THE SEQUENCE OF VEHICLE TAGGED WITH AND WITHOUT RFID

FIELD OF THE INVENTION

The present invention relates to a field of wireless positioning, and more particularly to a method for determining the sequence of vehicle tagged with and without a radio-frequency identification (RFID) by using wireless communication technology.

BACKGROUND OF THE INVENTION

In a present application of an automatic toll for highways, a wireless receiving and transmitting RFID tag is installed in a vehicle. When the vehicle drives through a highway automatic toll gate, another wireless transceiver or an RFID tag reader-writer assembled above the toll gate reads the RFID tag installed in the vehicle. As the surrounding material of the toll gate and the surrounding vehicle situation are complex, it always arises that the reader-writer of a lane reads an RFID tag of a vehicle in an adjacent lane or an RFID in a rear vehicle is read by the RFID tag reader-writer of the roll gate which is going to read the RFID tag in the front vehicle because of the reflection, thereby leading to a payment error. Furthermore, a sudden lane change and speeding behavior are also the major causes of traffic accidents.

The present technology whereby induction coils placed in read-write regions are collected to judge whether the read tag ID is the right tag of the vehicle on this lane. But in many cases where both lanes are occupied by the vehicles or the vehicle ahead is in the induction coil but the rear vehicle is read, therefore, this method is not highly accurate. The sensitivity and the transmitting power of the RFID tag are also carefully judged so the RFID tag can be read in a defined region. However, by this method, the sensitivity of a plurality of the RFID tags needed to be judged which leads to the cost of RFID tags to increase. In the meantime, because the surrounding situation of the roll gate is very complex, this also leads to a change of the read-write region.

SUMMARY OF THE INVENTION

The object of the present invention is to overcome the shortcoming of the conventional technology and provide a method for determining the sequence of vehicle tagged with and without an RFID, the method comprises: f1. carrying out multiple receiving and transmitting communications with an RFID tag in a read-write region via an RFID reader-writer, and recording success and failure operations in a time sequence; f2. setting a time window, moving the time window from left to right on a time axis, and adding the success times of the receiving and transmitting communications recorded in the step f1 in the time window to obtain a curve a; f3. detecting vehicles in the read-write region by using a ground induction coil to obtain a curve b; f4: when detecting a square wave in the curve b, indicating that there is at least one vehicle driving through the ground induction coil, judging whether the driven through vehicle is installed with an RFID tag according to the wave time relationship between the curve a and the curve b, and judging whether there is a vehicle without an RFID tag among the vehicles with RFID tags driving through, according to the matching degree of the vehicle speed calculated by the curve a and the curve b; the judging time being from a falling edge of the curve b as a starting point to backtrack to the previous falling edge, the judging method being: if the curve a has no pulse matched the set conditions, it is judged that one or more vehicles without the RFID drive through; it is needed manual or other technical process to determine the total number of the vehicles and the orders; if the curve a has one pulse matched the set conditions, and it is detected by the induction coil, i.e. a vehicle speed is obtained by the curve b, which is defined as a first speed. It is read and written by the RFID, i.e. the speed is obtained by the curve a, which is defined as a second speed. If the first speed is equal to the second speed within a certain range, it is judged that a vehicle with the RFID drives through. When the first speed is not equal to the second speed in the certain range, it is judged that one vehicle with the RFID and at least one vehicle without the RFID drive through. Meanwhile, it is needed manual or other technical process to determine the total number of the vehicles and the orders. If the curve a has two pulses matched the set conditions, when the first speed is equal to the second speed in the certain range, it is judged that two vehicles with the RFIDs drive through; when the first speed is not equal to the second speed in the certain range, it is judged that two vehicles with the RFIDs and at least one vehicle without the RFID drive through. Meanwhile, it requires manual or other technical process to determine the total number of the vehicles and the order. If the curve a has n ($n>2$) pulses matched the set conditions, when the first speed is equal to the second speed in the certain range, it is judged that n vehicles with the RFIDs drive through; when the first speed is not equal to the second speed in the certain range, it is judged that n vehicles with the RFIDs and at least one vehicle without the RFID drive through. It requires manual or other technical process to determine the total number of the vehicles and the orders.

Said ground induction coil detects the vehicles to enter in and left from an edge of the ground induction coil constantly, when one vehicle is in the ground induction coil, the first speed of the vehicle is obtained by the vehicle length coming from the car model information pre-stored in the RFID dividing by the time of the vehicle driving through the ground induction coil. When n ($n\geq2$) vehicles are in the ground induction coil, the speed of the vehicle in the ground induction coil is obtained by the sum of the length of the vehicles adding identified shortest distance of $n-1$ and dividing by the time of the vehicle driving through the ground induction coil.

Said second speed of the vehicle can be obtained by the aforementioned method of calculating the running speed of the vehicle.

Said length of the vehicle coming from car model information pre-stored in the RFID means a part of the length of the vehicle which drives through the grounding induction coil to form the induction square wave.

The method for detecting the vehicles by said grounding induction coil can also be replaced by other methods for detecting vehicles, comprises mechanical detection, optical, image processing, infrared light curtains and laser detection.

For a more complete understanding of the present invention, and the advantages thereof, reference is now made to the following descriptions taken in conjunction with the accompanying drawings.

DETAILED DESCRIPTION OF THE PREFERRED EMBODIMENT

The foregoing has outlined rather broadly the features and technical advantages of the present invention in sequence that the detailed description of the invention that follows may be better understood.

Figure 1:
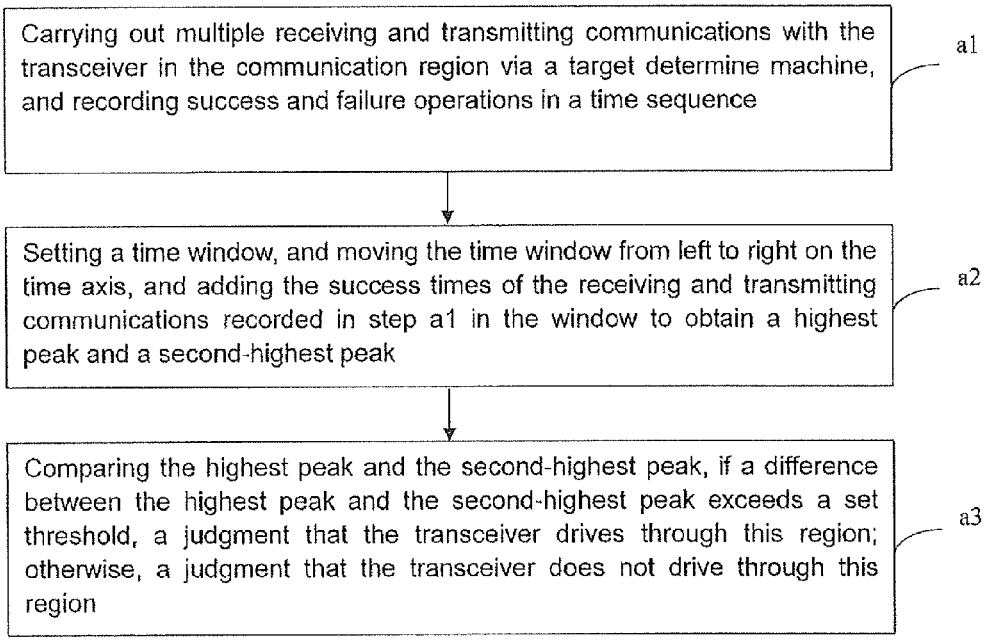
FIG. 1 shows a method for judging a position of a transceiver by using wireless communication technology in accordance with the present invention.

Please refer to FIG. 1, FIG. 1 illustrates a method for judging the position of a transceiver by using wireless communication technology in accordance with the present invention, the method comprises: a1. carrying out multiple receiving and transmitting communications with the transceiver in the communication region via a target determine machine, and recording success and failure operations in a time sequence; a2. setting a time window, moving the time window from left to right on the time axis, and adding the success times of the receiving and transmitting communications recorded in step a1 in the window to obtain a highest peak and a second-highest peak; a3. comparing the highest peak and the second-highest peak, if a difference between the highest peak and the second-highest peak exceeds a set threshold, a judgment that the transceiver drives through this region is given; otherwise, a judgment that the transceiver does not drive through this region is given. If the receiving and transmitting communication of the step a1 is a read operation, once the detected absolute value of a curve value exceeds the set threshold, the target determine machine proceeds a write operation quickly with the transceiver in the communication region and continues the previous multiple read operations after completing said write operation. If the receiving and transmitting communication of the step a1 is the write operation, once the detected absolute value of the curve value exceeds the set threshold, the target determine machine proceeds the read operation quickly with the transceiver in the communication region and continues the previous multiple write operations after completing said read operation.

Figure 2:
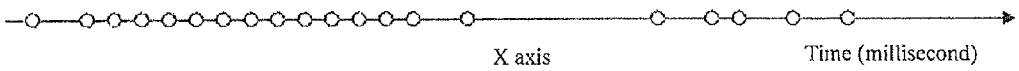
FIG. 2 shows to carry out multiple receiving and transmitting communications with the transceiver in the communication region via a target determine machine, and recording success and failure operations in a time sequence.
Figure 3:
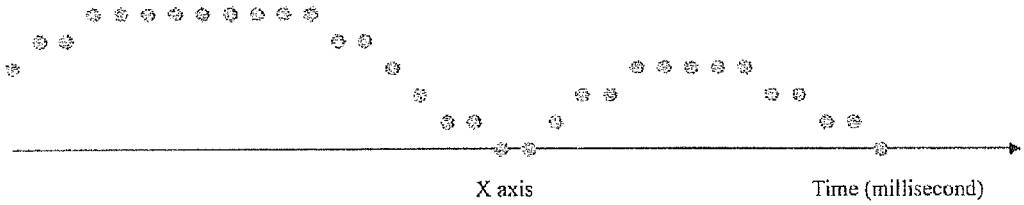
FIG. 3 shows to move the time window from left to right on the time axis, and add the success reading communication times in the window to obtain a diagram.

Please refer to FIG. 2 and FIG. 3, FIG. 2 shows that the target determine machine carries out multiple receiving and transmitting communications with the transceiver in the communication region, and records success and failure operations in a time sequence, the horizontal axis represents time. FIG. 3 shows the time window is moved from left to right on the time axis and add the success read communication times in the window to obtain a diagram, the horizontal axis represents time, the size of the time window can be adjusted and the moving step of the window can be adjusted.

Figure 4:
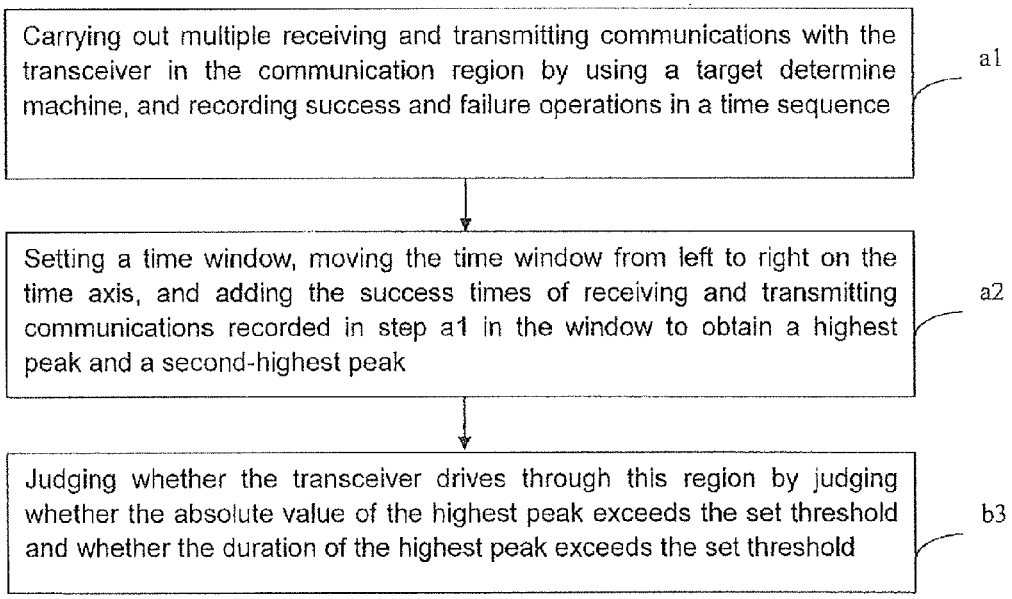
FIG. 4 shows another method for judging the position of the transceiver by using wireless communication technology.

Please further refer to FIG. 4, FIG. 4 shows that the step a3 of FIG. 1 can be replaced by: b3. judging whether the transceiver drives through this region by judging whether the absolute value of the highest peak exceeds the set threshold and whether the duration of the highest peak exceeds the set threshold. FIG. 4 shows the method for judging the position of the transceiver by using wireless communication technology in accordance with the present invention, comprises: at carrying out multiple receiving and transmitting communications with the transceiver in the communication region via a target determine machine, and recording success and failure operations in a time sequence; a2. setting a time window, moving the time window from left to right on a time axis, adding the success times of the receiving and transmitting communications recorded in step a1 in the window to obtain a highest peak and a second-highest peak; b3. judging whether the transceiver drives through this region by judging whether the absolute value of the highest peak exceeds the set threshold and whether the duration of the highest peak exceeds the set threshold.

Figure 5:
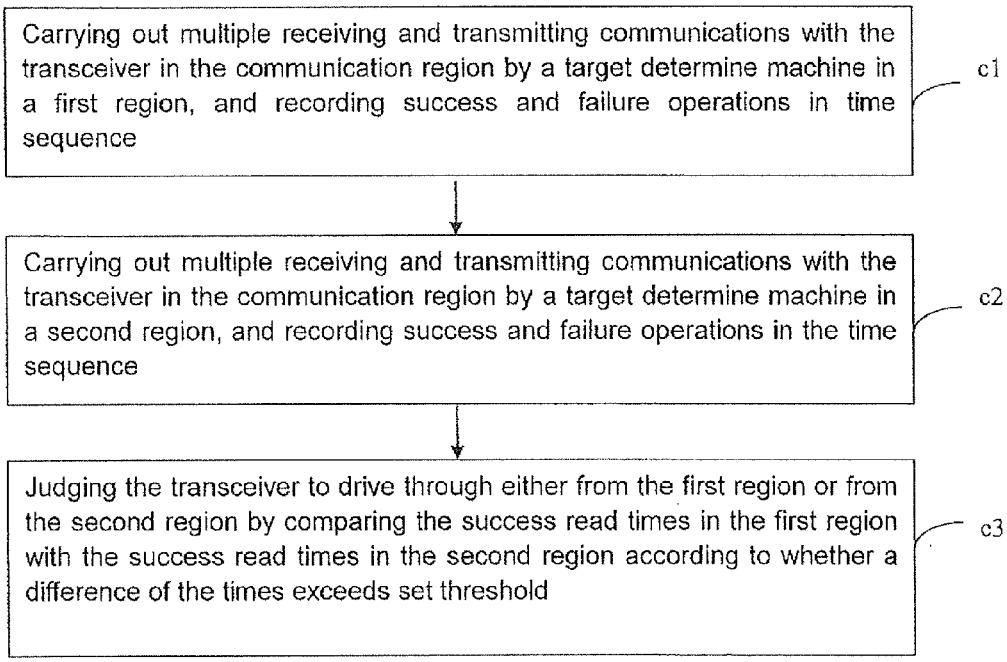
FIG. 5 shows a different method for judging the position of the transceiver by using wireless communication technology.

Please refer to FIG. 5, FIG. 5 shows a different method for judging the position of a transceiver by using wireless communication technology, the method comprises: c1. carrying out multiple receiving and transmitting communications with the transceiver in the communication region via a target determine machine in a first region, and recording success and failure operations in a time sequence; c2. carrying out multiple receiving and transmitting communications with the transceiver in the communication region via a target determine machine in a second region, and recording success and failure operations in a time sequence; c3. judging the transceiver to drive through either from the first region or from the second region by comparing the success read times in the first region with the success read times in the second region according to whether a difference of the times exceeds set threshold. If the operation of the receiving and transmitting communication of the step c1 is the read operation, once the detected absolute value of the curve value exceeds the set threshold, the target determine machine proceeds the write operation quickly with the transceiver in the communication region and continues the previous multiple read operations after completing said write operation. If the operation of the receiving and transmitting communication of the step c1 is the write operation, once the detected absolute value of the curve value exceeds the set threshold, the target determine machine proceeds the read operation quickly with the transceiver in the communication region and continues the previous multiple write operations after completing said read operation.

Figure 6:
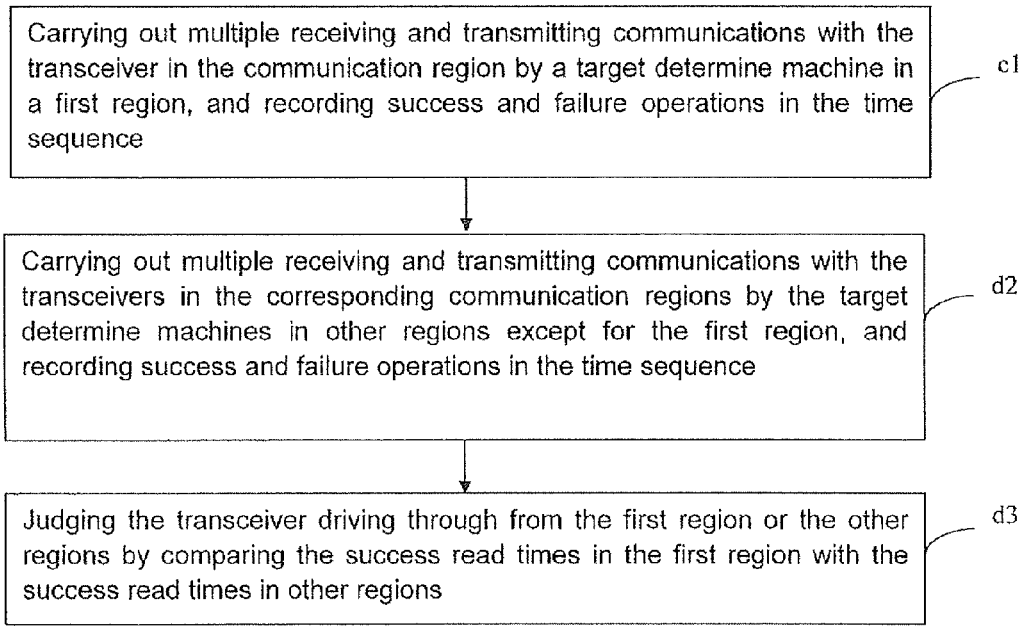
FIG. 6 shows a diverse method for judging the position of the transceiver by using wireless communication technology.

Please refer to FIG. 6, FIG. 6 shows that the step c2 of FIG. 5 can be repeated, i.e. said steps c2, c3 can be replaced as follows: d2. carrying out multiple receiving and transmitting communications with the transceivers in the corresponding communication regions via the target determine machines in other regions except for the first region, and recording success and failure operations in a time sequence; d3. judging the transceiver driving through from the first region or the other regions by comparing the success read times in the first region with the success read times in other regions.

The methods described in FIG. 1 to FIG. 6 can be applied in many aspects, such as the RF field, meanwhile, said transceiver is the RFID tag, said target determine machine is the RFID reader-writer, said region is the lane. The receiving and transmitting communication is one of the read or write operations. But it is obviously, the methods of the present invention are not limited be applied in the RF field, they can be also applied in other fields; it will be not further repeated here.

Figure 7:
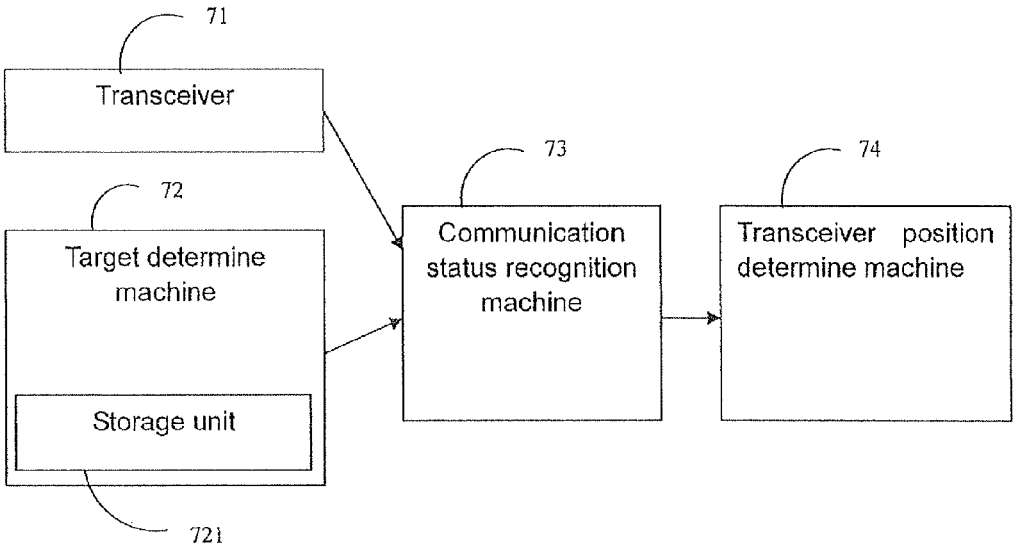
FIG. 7 shows a system for judging the position of the transceiver by using wireless communication technology in accordance with the present invention.

According to above methods, the present invention also provides a system for judging a position of the transceiver by using wireless communication technology, please refer to FIG. 7, comprises: the transceiver 71; the target determine machine 72, carrying out multiple receiving and transmitting communications with the transceiver in the communication region, and recording success and failure operations in a time sequence, and saving said operations in a storage unit 721; a communication status recognition machine 73, setting a time window, moving the window from left to right on a time axis, and adding the success receiving and transmitting communication times recorded in the target determine machine in the window to obtain the highest peak and the second-highest peak; and a transceiver position determine machine 74, judging the region of the transceiver driving through according to the highest peak and the second-highest peak. Said transceiver position determine machine 74 can judge the region of the transceiver driving through by comparing whether the highest peak and the second highest peak exceed the threshold; and judge whether the transceiver drives through the region by comparing whether the absolute value of the highest peak exceeds the set threshold.

Figure 8:
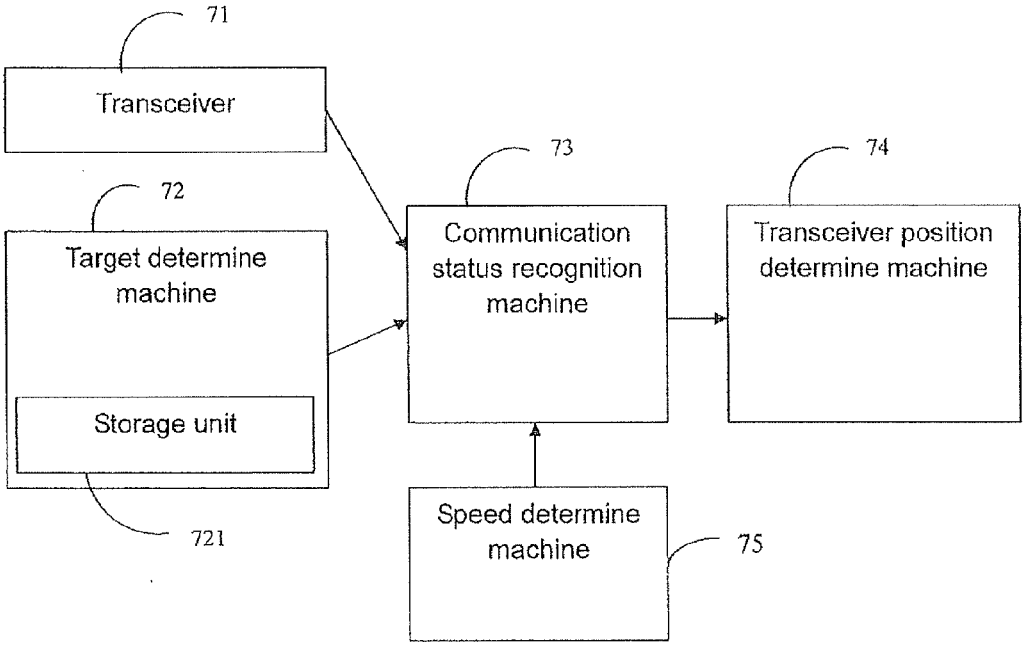
FIG. 8 shows the system shown in FIG. 7 being applied in an RF field.

The system shown in FIG. 7 is used in the RF field, meanwhile, said transceiver is the RFID tag, said target determine machine is the RFID reader-writer and said region is the lane. The receiving and transmitting communication is one of the read or write operations. Please refer to FIG. 8, meanwhile, said system may further comprises a speed determine machine 75, said speed determine machine 75 uses that a distance between RFID reader-writers of two adjacent peaks divides by the interval time between two adjacent peaks to obtain the running speed of the vehicle when the vehicle changes the lanes. Said size of the time window can be adjusted, said threshold is changeable according to a change of the size of the time window. All thresholds can be adjusted according to the height of the transceivers and can be also adjusted according to the transmitting power and the receiving sensitivity of the target determine machine and the transceiver.

Figure 9:
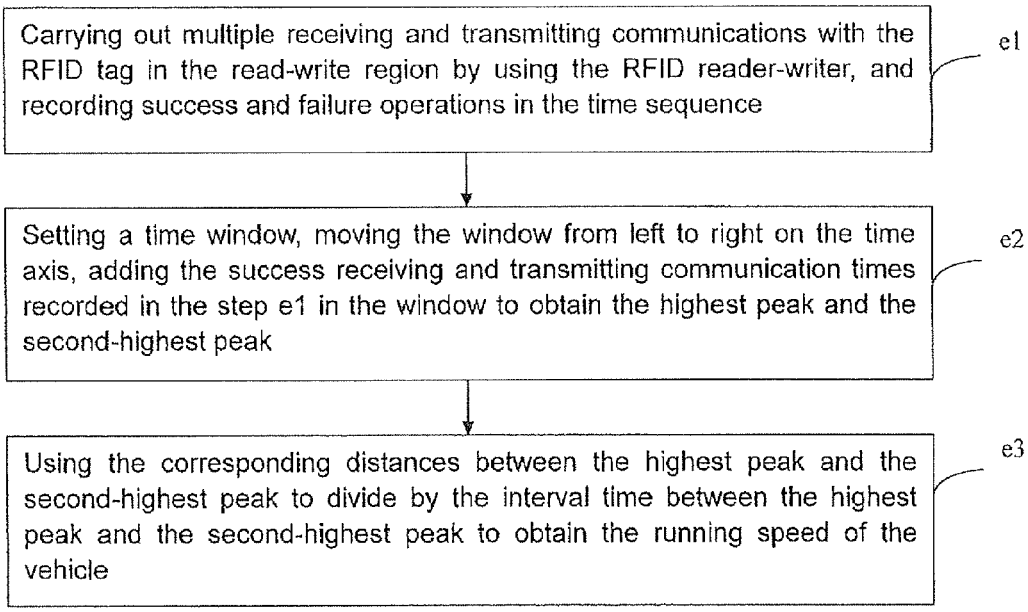
FIG. 9 shows a method for calculating running speed of the vehicle in accordance with the present invention.

Please refer to FIG. 9, according to above methods, the present invention also provides a method for calculating the running speed of the vehicle, comprises: e1. carrying out multiple receiving and transmitting communications with the RFID tag in the read-write region via the RFID reader-writer, and recording success and failure operations in a time sequence; e2. setting a time window, moving the window from left to right on the time axis, adding the success receiving and transmitting communication times recorded in the step e1 in the window to obtain the highest peak and the second-highest peak; e3. using the corresponding distances between the highest peak and the second-highest peak to divide by the interval time between the highest peak and the second-highest peak to obtain the running speed of the vehicle. Said corresponding distance between the highest peak and the second-highest peak is the distance between the main communication region and the reflection region. Said method can calculate the average speed in the read-write region of the vehicle by using duration of the highest peak and a range of the read-write region.

Figure 10:
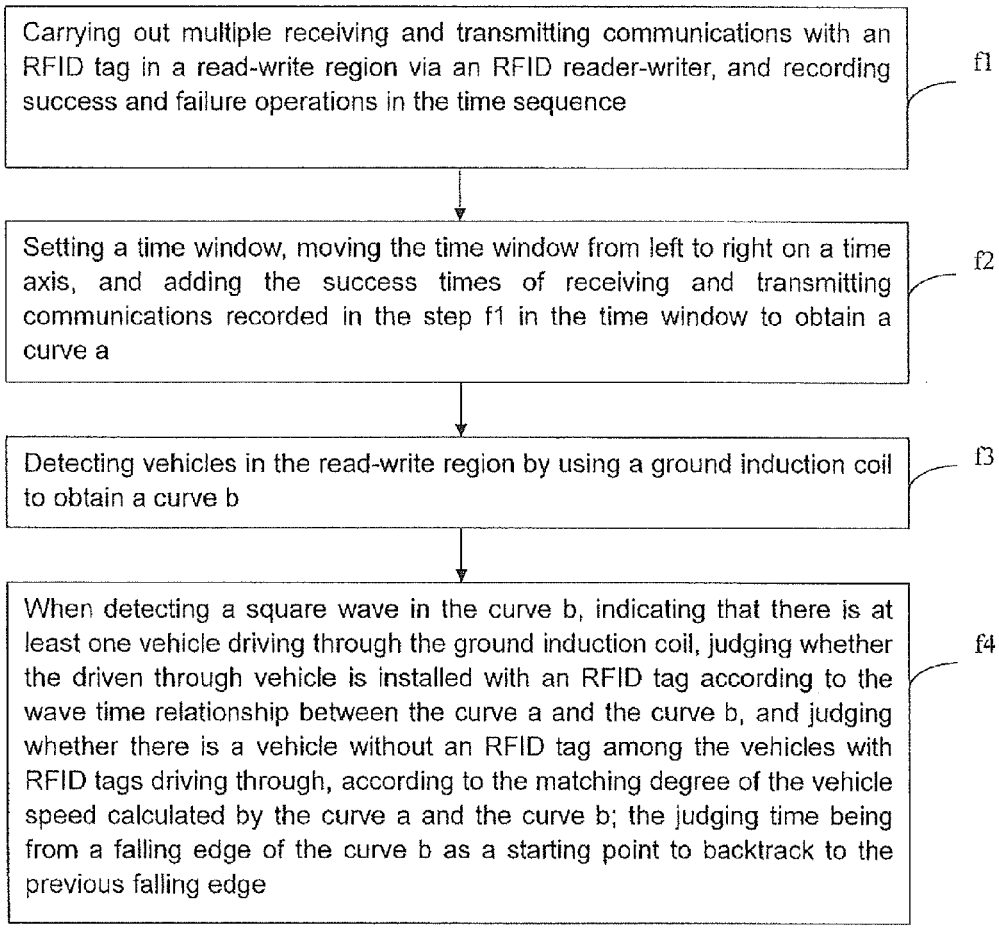
FIG. 10 shows a method for determining the sequence of vehicle tagged with and without an RFID in accordance with the present invention.
Figure 11:
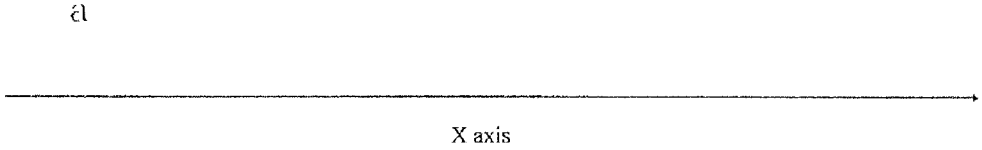
FIG. 11 shows the curve a having no pulse matched the set conditions.
Figure 12:
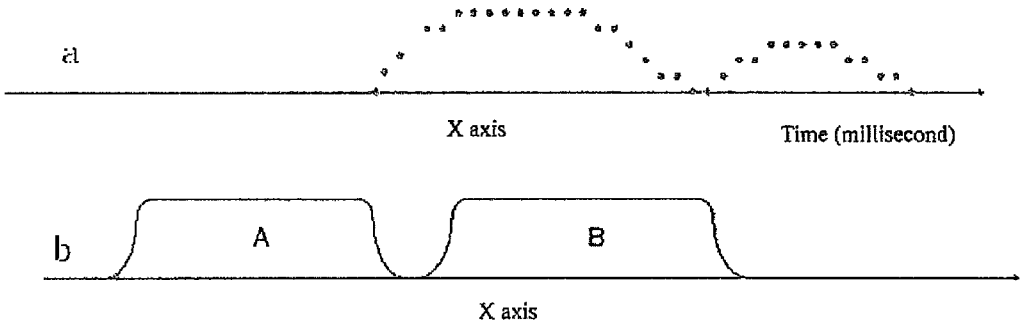
FIG. 12 shows the curve a having one pulse matched set conditions.
Figure 13:
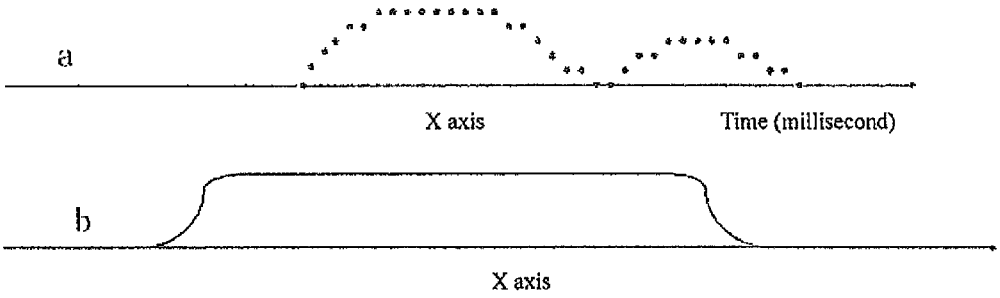
FIG. 13 also shows the curve a having one pulse matched set conditions.

The present invention also provides a method for determining the sequence of vehicle tagged with and without RFIDs by using above methods, it is designed for a system of electronic toll collection without halt for detecting simultaneously the vehicles with tags and the vehicles without tags in the highway. When the lane is used for the vehicles with tags and the vehicles without tags simultaneously, it usually adopts other means except for the RFID reader-writer to assist in the detection of the vehicles without tags. The more common means are the grounding induction coil or the infrared light curtain or the image processing; this brings a question for how to correspond the RFID reader-writer with the detecting result of the detector of the second type vehicle. If the correspondence is wrong, it will bring wrong payment and penalty. A method is shown in FIG. 10 to FIG. 15: FIG. 10 shows the steps comprised by the method, it is obvious that the orders of the steps is not limited to the descriptive orders; FIG. 11 shows that the curve a has no pulse matched the set conditions; FIG. 12 and FIG. 13 show that curve a has a pulse matched the set conditions.

Please refer to FIG. 10, said method comprises the following steps: f1. carrying out multiple receiving and transmitting communications with an RFID tag in a read-write region by using an RFID reader-writer, and recording success and failure operations in a time sequence; f2. setting a time window, moving the time window from left to right on a time axis, and adding the success times of the receiving and transmitting communications recorded in the step f1 in the time window to obtain a curve a; f3. detecting vehicles in the read-write region by using a ground induction coil to obtain a curve b; f4: when detecting a square wave in the curve b, indicating that there is at least one vehicle driving through the ground induction coil, judging whether the driven through vehicle is installed with an RFID tag according to the wave time relationship between the curve a and the curve b, and judging whether there is a vehicle without an RFID tag among the vehicles with RFID tags driving through, according to the matching degree of the vehicle speed calculated by the curve a and the curve b; the judging time being from a falling edge of the curve b as a starting point to backtrack to the previous falling edge.

A judging method of step f4 is:

If the curve a has no pulse matched the set conditions, it is judged that one or more vehicles without the RFID drive through; it is needed manual or other technical process to determine the total number of the vehicles and the orders, which is shown in FIG. 11.

If the curve a has one pulse matched the set conditions, and it is detected by the induction coil, i.e. the vehicle speed is obtained by the curve b, which is defined as a first speed, It is read and written by the RFID, i.e. the speed is obtained by the curve a, which is defined as a second speed. If the first speed is equal to the second speed within a certain range, it is judged that a vehicle with the RFID drives through. When the first speed is not equal to the second speed in the certain range, it is judged that one vehicle with the RFID and at least one vehicle without the RFID drive through. Meanwhile, it is needed manual or other technical process to determine the total number of the vehicles and the orders, which is shown in FIG. 12 and FIG. 13.

If the curve a has two pulses matched the set conditions, when the first speed is equal to the second speed in the certain range, it is judged that two vehicles with the RFIDs drive through; when the first speed is not equal to the second speed in the certain range, it is judged that two vehicles with the RFIDs and at least one vehicle without the RFID drive through. Meanwhile, it requires manual or other technical process to determine the total number of the vehicles and the orders.

If the curve a has n (n>2) pulses matched the set conditions, when the first speed is equal to the second speed in the certain range, it is judged that n vehicles with the RFIDs drive through; when the first speed is not equal to the second speed in the certain range, it is judged that n vehicles with the RFIDs and at least one vehicle without the RFID drive through. It requires manual or other technical process to determine the total number of the vehicles and the order.

Said ground induction coil detects the vehicles to enter in and left from an edge of the ground induction coil constantly, when one vehicle is in the ground induction coil, the first speed of the vehicle is obtained by the vehicle length coming from the car model information pre-stored in the RFID dividing by the time of the vehicle driving through the ground induction coil. When n (n≥2) vehicles are in the ground induction coil, the speed of the vehicle in the ground induction coil is obtained by the sum of the length of the vehicles adding identified shortest distance of n−1 and dividing by the time of the vehicle driving through the ground induction coil. Said second speed of the vehicle can be obtained by the aforementioned method of calculating the running speed of the vehicle. Said length of the vehicle coming from car model information pre-stored in the RFID means a part of the length of the vehicle which drives through the grounding induction coil to form induction square wave. Said length of the vehicle is possibly or not possibly equal to the actual length of the vehicle. The method for detecting the vehicles by said grounding induction coil can also be replaced by other methods for detecting vehicles, comprises mechanical detection, optical, image processing, infrared light curtains and laser detection.

Figure 14:
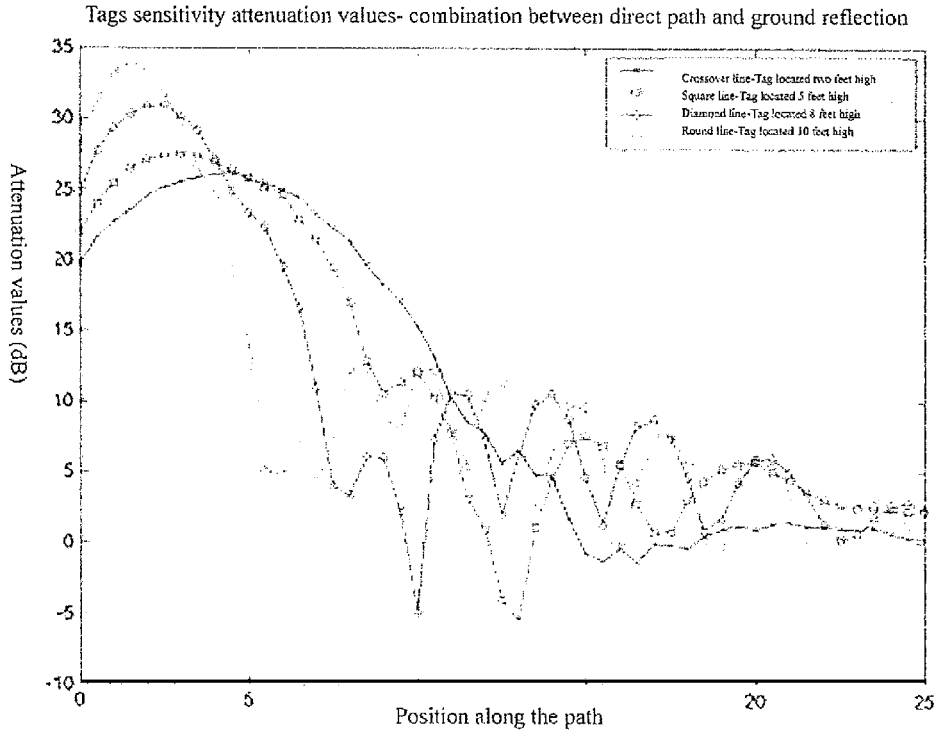
FIG. 14 shows multipath effect.
Figure 15:
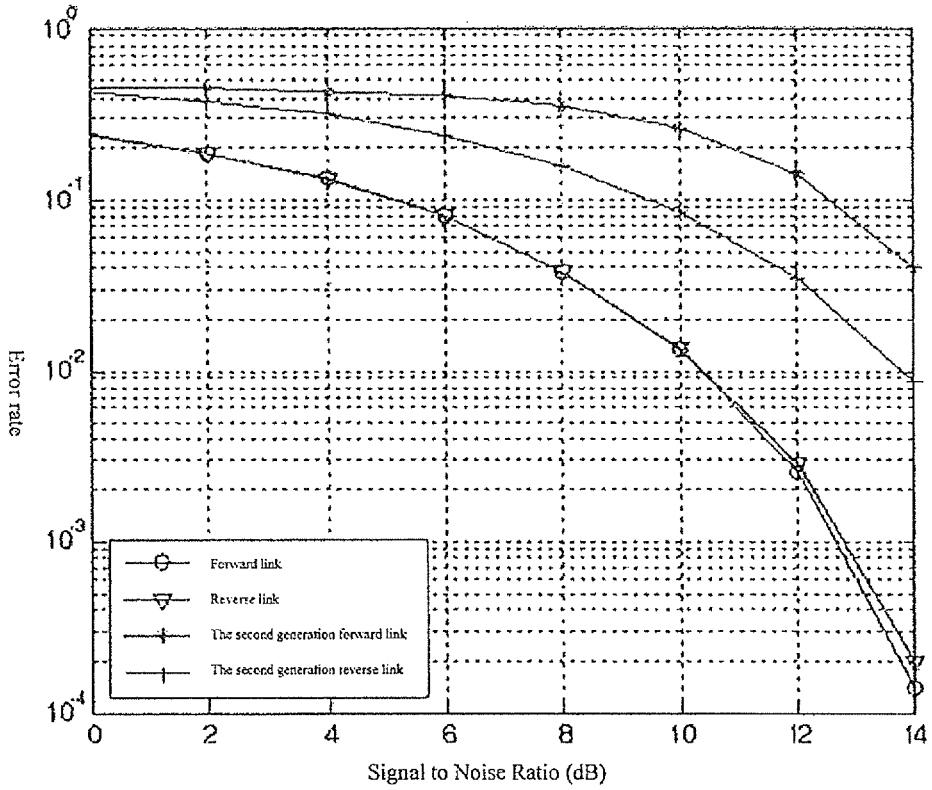
FIG. 15 shows the success rate of wireless communication being inversely proportional to the strength of RF within the certain region.

Please refer to FIG. 14 and FIG. 15. FIG. 14 shows the multipath effect; FIG. 15 shows the success rate of wireless communication being inversely proportional to the strength of RF within the certain region. The present invention proceeds from the multipath effect, and success rate of the wireless communication being inversely proportional to the strength of RF within certain strength region, carries out the receiving and transmitting communications (read or write) with the RFID tag rapidly and repeatedly, and analyses the success rate by using the time window, and can find the largest RF reflection region, thereby achieving to locate the RFID tag.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A method for determining the sequence of vehicle tagged with and without an RFID (radio-frequency identification), the method comprising:

f1 . carrying out multiple receiving and transmitting communications with an RFID tag in a read-write region via an RFID reader-writer, and recording success and failure operations in a time sequence;

f2. setting a time window, moving the time window from left to right on a time axis, and adding the success times of the receiving and transmitting communications recorded in the step f1 in the time window to obtain a curve a;

f3. detecting vehicles in a read-write region by using a ground induction coil to obtain a curve b;

f4. when detecting a square wave in the curve b, indicating that there is at least one vehicle driving through the coil, judging whether the driven through vehicle is installed with an RFID tag according to the wave time relationship between the curve a and the curve b, and judging whether there is a vehicle with and/or without an RFID tag among the vehicles with RFID tags driving through, according to the matching degree of the vehicle speed calculated by the curve a and the curve b; the judging time being from a falling edge of the curve b as a starting point to backtrack to the previous falling edge, the judging method being:

if the curve a has no pulse matching the set conditions, it is judged that one or more vehicles without the RFID had driven through; there is required a manual work or other technical process to determine the total number of the vehicles and the orders;

if the curve a has one pulse matched the set conditions, and it is detected by the induction coil, the vehicle speed is obtained by the curve b, which is defined as a first speed; it is read and written by the RFID, the speed is obtained by the curve a, which is defined as a second speed; if the first speed is equal to the second speed within a certain range, it is judged that a vehicle with the RFID drives through; when the first speed is not equal to the second speed in the certain range, it is judged that one vehicle with the RFID and at least one vehicle without the RFID drive through; it is needed manual or other technical process to determine the total number of the vehicles and the orders;

if the curve a has two pulses matched the set conditions, when the first speed is equal to the second speed in the certain range, it is judged that two vehicles with the RFIDs drive through; when the first speed is not equal to the second speed in the certain range, it is judged that two vehicles with the RFIDs and at least one vehicle without the RFID drive through; it requires manual or other technical process to determine the total number of the vehicles and the orders;

if the curve a has n (n>2) pulses matched the set conditions, when the first speed is equal to the second speed in the certain range, it is judged that n vehicles with the RFIDs drive through; when the first speed is not equal to the second speed in the certain range, it is judged that n vehicles with the RFIDs and at least one vehicle without the RFID drive through; it requires manual or other technical process to determine the total number of the vehicles and the order.

2. The method for determining the sequence of vehicle tagged with and without an RFID according to claim 1, wherein said ground induction coil detects the vehicles to enter in and left from an edge of the ground induction coil constantly, when one vehicle is in the ground induction coil, the first speed of the vehicle is obtained by the vehicle length coming from the car model information pre-stored in the RFID dividing by the time of the vehicle driving through the ground induction coil; when n (n≥2) vehicles are in the ground induction coil, the speed of the vehicle in the ground induction coil is obtained by the sum of the length of the vehicles adding identified shortest distance of n−1 and dividing by the time of the vehicle driving through the ground induction coil.

3. The method for determining the sequence of vehicle tagged with and without an RFID according to claim 2, wherein said length of the vehicle coming from car model information pre-stored in the RFID means a part of the length of the vehicle which drives through the grounding induction coil to form induction square wave.

4. The method for determining the sequence of vehicle tagged with and without an RFID according to claim 1, wherein the method for detecting the vehicles by said grounding induction coil can also be replaced by other methods for detecting vehicles, comprises mechanical detection, optical, image processing, infrared light curtains and laser detection.

5. The method for determining the sequence of vehicle tagged with and without an RFID according to claims 2, wherein the method for detecting the vehicles by said grounding induction coil can also be replaced by other methods for detecting vehicles, comprises mechanical detection, optical, image processing, infrared light curtains and laser detection.

6. The method for determining the sequence of vehicle tagged with and without an RFID according to claims 3, wherein the method for detecting the vehicles by said grounding induction coil can also be replaced by other methods for detecting vehicles, comprises mechanical detection, optical, image processing, infrared light curtains and laser detection.

* * * * *